United States Patent [19]

Bisaiji

[11] Patent Number: 4,678,318

[45] Date of Patent: Jul. 7, 1987

[54] IMAGE FORMING APPARATUS

[75] Inventor: Takashi Bisaiji, Kanagawa, Japan

[73] Assignee: Ricoh Company, Ltd., Tokyo, Japan

[21] Appl. No.: 785,066

[22] Filed: Oct. 7, 1985

[30] Foreign Application Priority Data

Oct. 5, 1984 [JP] Japan ..... 59-150191[U]

[51] Int. Cl.[4] ..... G03G 21/00

[52] U.S. Cl. ..... 355/15; 118/652

[58] Field of Search ..... 355/15, 3 DD, 3 DR, 355/3 R; 118/652; 15/256.5, 256.51

[56] References Cited

U.S. PATENT DOCUMENTS 4,376,577 3/1983 Okamoto ..... 355/3 R 4,386,838 6/1983 Hirabayashi ..... 355/3 DR

*Primary Examiner*—R. L. Moses

*Attorney, Agent, or Firm*—Oblon, Fisher, Spivak, McClelland & Maier

[57] ABSTRACT

An image forming apparatus such as an electrophotographic copying apparatus has a latent image carrier and a cleaning unit which can be drawn together out of the apparatus housing. After the latent image carrier and the cleaning unit has been pulled out, the cleaning unit is angularly moved around the latent image carrier to direct its cleaning position or slot upwardly. Then, the latent image carrier and the cleaning unit are separated from each other. Since the cleaning slot is directed upwardly, toner collected in the cleaning unit will not be spilled or scattered around through the cleaning slot. The cleaning unit may be coupled with a toner cartridge for collecting toner from the cleaning unit.

4 Claims, 6 Drawing Figures

IMAGE FORMING APPARATUS

BACKGROUND OF THE INVENTION

The present invention relates to an image forming apparatus such as an electrophotographic apparatus or an electrostatic recording apparatus employing a dielectric latent image carrier.

Image forming apparatus have a photoconductive or dielectric latent image carrier which is in repeated use when forming desired images. The image forming apparatus are therefore required to incorporate a cleaning unit for cyclically cleaning the latent image carrier.

FIG. 6 of the accompanying drawings illustrates a conventional electrophotographic apparatus known as an image forming apparatus.

The illustrated electrophotographic apparatus includes a photosensitive drum 1 serving as a latent image carrier, a charger 2 for charging the photosensitive drum 1, an exposure system 3 for exposing the photosensitive drum 1 to the optical image of an original to be copied, a development device 4 for developing a latent image on the photosensitive drum 1 into a visible image of toner, a charger 5 for transferring the visible image from the photosensitive drum 1 to a sheet and separating the sheet from the photosensitive drum 1, a cleaning unit 6 having a cleaning blade held in contact with the photosensitive drum 1 for scraping any residual toner off the photosensitive drum 1 to clean the same, and an erase lamp 7 for erasing any residual charge from the photosensitive drum 1.

The cleaning unit can be detached from the electrophotographic apparatus. When the cleaning unit is to be separated from the photosensitive drum 1 for replacing the cleaning blade with a new one, the scraped toner collected in the cleaning unit 6 tends to fall and be scattered to smear the operator and surroundings.

SUMMARY OF THE INVENTION

It is an object of the present invention to provide an image forming apparatus in which removed toner collected in a cleaning unit will not be spilled or scattered around when the cleaning unit is to be detached.

According to the present invention, a latent image carrier and at least a cleaning unit of an image forming apparatus are detachable from the housing of the image forming apparatus. The cleaning unit is angularly movable to direct its cleaning position or slot upwardly. When the cleaning unit is to be dismounted, the latent image carrier and the cleaning unit are drawn together out of the apparatus housing, and then separated from each other after the cleaning position has been directed upwardly. Since the cleaning position or slot of the cleaning unit is directed upwardly at the time of separating the latent image carrier and the cleaning unit from each other, no toner is spilled or scattered from the cleaning slot, and the operator and surroundings will not be smeared by toner.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
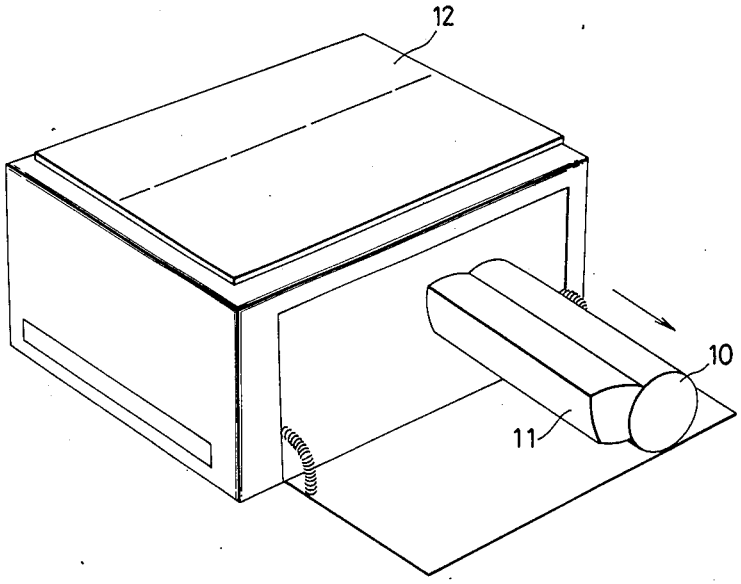
FIG. 1 is a perspective view of an image forming apparatus according to an embodiment of the present invention, the view showing a photosensitive drum or latent image carier and a cleaning unit which are drawn out together out of the apparatus housing.
Figure 2:
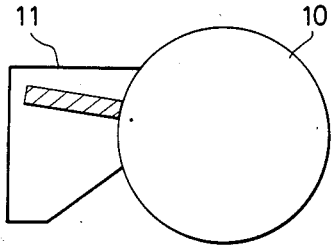
FIG. 2 is a front elevational view of the photosensitive drum and the cleaning unit shown in FIG. 1.

FIG. 1 schematically shows an electrophotographic copying apparatus having a photoconductive photosensitive drum 10 serving as a latent image carrier and a cleaining unit 11 for cleaning the photosensitive drum 10. For detaching the cleaning unit 11, the photosensitive drum 10 and the cleaning unit 11 are drawn together out of an apparatus housing 12 in the direction of the arrow. FIG. 2 shows the photosensitive drum 10 and the cleaning unit 11 as they are pulled out of the apparatus housing 12. The cleaning unit 11 has a cleaning blade with its distal edge held against the circumferential surface of the photosensitive drum 1 through a cleaning position or slot for scraping residual toner off the photosensitive drum 1.

Figure 3:
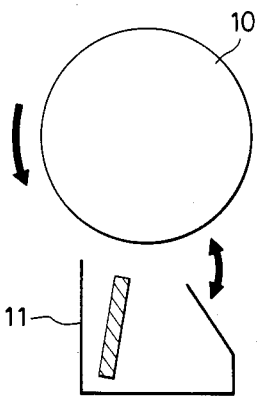
FIG. 3 is a front elevational view of the photosensitive drum and the cleaning unit which is angularly moved to direct its cleaning position or slot upwardly.
Figure 4:
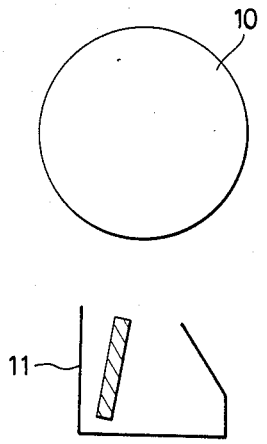
FIG. 4 is a front elevational view of the photosensitive drum and the cleaning unit which are separated from each other.

After the photosensitive drum 10 and the cleaning unit 11 have been drawn out of the housing 12, the cleaning unit 11 is angularly moved downwardly along the circumferential surface of the photosensitive drum 10 as illustrated in FIG. 3 to direct its cleaning position or slot upwardly. The photosensitive drum 10 is now moved vertically, horizontally, and back and forth so as to be separated from the cleaning unit 11, as shown in FIG. 4. Alternatively, the photosensitive drum 10 is held in position and the cleaning unit 11 is moved vertically, horizontally, and back and forth so as to be separated from the photosensitive drum 10. At this time, toner scraped off the photosensitive drum 10 and collected in the cleaning unit 11 is not spilled or scattered around through the cleaning slot since the cleaning slot is directed upwardly.

Figure 5:
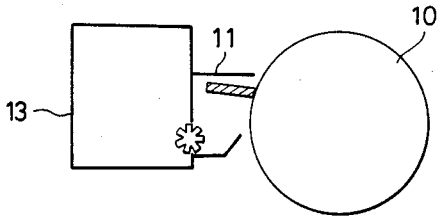
FIG. 5 is a front elevational view of an image forming apparatus according to another embodiment of the present invention.
Figure 6:
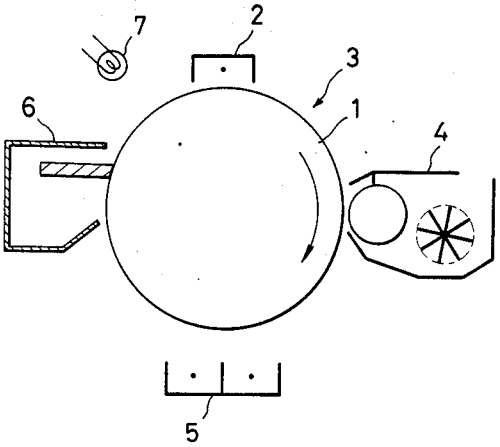
FIG. 6 (PRIOR ART)
FIG. 6 is a front elevational view of a conventional image forming apparatus.

FIG. 5 illustrates an image forming apparatus according to another embodiment of the present invention. The cleaning unit 11 is coupled with a toner cartridge 13 for collecting toner from the cleaning unit 11. The other structural details and operation of the arrangement of FIG. 5 are the same as those shown in FIGS. 1 through 4.

Although certain preferred embodiments have been shown and described, it should be understood that many changes and modifications may be made therein without departing from the scope of the appended claims.

What is claimed is:

1. An image forming apparatus comprising:

a housing;

a latent image carrier removably disposed in said housing;

a cleaning unit removably disposed in said housing and having a cleaning blade held against said latent image carrier through a cleaning slot;

means for coupling said latent image carrier and said cleaning unit in said housing such that said coupled unit may be removed from said housing;

and wherein said cleaning unit further comprises means to angularly direct said cleaning slot upwardly when removed from said housing.

2. An image forming apparatus according to claim 1, wherein said latent image carrier comprises a photoconductive photosensitive body.

3. An image forming apparatus according to claim 1, wherein said latent image carrier comprises a dielectric body.

4. An image forming apparatus according to claim 1, including a toner cartridge coupled to said cleaning unit for collecting toner therefrom.

* * * * *